US010042321B2

(12) United States Patent
Abe et al.

(10) Patent No.: US 10,042,321 B2
(45) Date of Patent: Aug. 7, 2018

(54) DRUM CARTRIDGE

(71) Applicant: BROTHER KOGYO KABUSHIKI KAISHA, Nagoya-shi, Aichi-ken (JP)

(72) Inventors: Koji Abe, Aichi (JP); Takashi Shimizu, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/471,763

(22) Filed: Mar. 28, 2017

(65) Prior Publication Data

US 2018/0017934 A1 Jan. 18, 2018

(30) Foreign Application Priority Data

Jul. 15, 2016 (JP) ..... 2016-140579

(51) Int. Cl.
*G03G 21/18* (2006.01)

(52) U.S. Cl.
CPC ..... *G03G 21/1842* (2013.01)

(58) Field of Classification Search
CPC ..... G03G 21/169; G03G 21/1857; G03G 21/0058; G03G 21/1825; G03G 21/1821; G03G 21/1671; G03G 21/0094; G03G 2221/1853
See application file for complete search history.

(56) References Cited

U.S. PATENT DOCUMENTS 7,840,154 B2 * 11/2010 Ishii ..... G03G 15/55 399/90
9,383,720 B1 * 7/2016 Fukamachi ..... G03G 21/1814
2006/0245787 A1 * 11/2006 Ito ..... G03G 21/0035 399/111
2009/0226209 A1 * 9/2009 Shiraki ..... G03G 21/1821 399/113
2010/0080610 A1 * 4/2010 Yoshizumi ..... G03G 21/1821 399/111
2013/0051849 A1 * 2/2013 Itabashi ..... G03G 21/1821 399/111
2015/0023692 A1 * 1/2015 Tanaka ..... G03G 21/1846 399/113
2015/0192878 A1 7/2015 Iriyama et al.

FOREIGN PATENT DOCUMENTS

JP 2015-146016 A 8/2015

* cited by examiner

*Primary Examiner* — Francis Gray
(74) *Attorney, Agent, or Firm* — Merchant & Gould P.C.

(57) ABSTRACT

A drum cartridge, comprising: a photosensitive drum; and a drum frame having a first state where a developing device is attached to the drum frame, the developing device including a developing roller, and a second state where a developing cartridge is detachably attachable to the drum frame, the developing cartridge including a developing roller and a developing frame which stores toner, wherein, in the first state, a toner cartridge is detachably attachable to the developing device.

12 Claims, 11 Drawing Sheets

DRUM CARTRIDGE

CROSS-REFERENCE TO RELATED APPLICATION

This application claims priority under 35 U.S.C. § 119 from Japanese Patent Application No. 2016-140579, filed on Jul. 15, 2016. The entire subject matter of the application is incorporated herein by reference.

BACKGROUND

Technical Field

Aspects of the present disclosure relate to a drum cartridge having a photosensitive drum.

Related Art

A drum cartridge to which a developing cartridge is detachably attachable is known. Specifically, in this technology, the developing cartridge is configured as an integrated type developing cartridge in which a developing device having a developing roller and a toner storing chamber which stores toner are integrally provided.

SUMMARY

In the meantime, there is a case where a developing cartridge is configured as a separate type developing cartridge in which a developing device having a developing roller and a toner storing chamber which stores toner are provided as separate components. In this case, it becomes necessary to configure the shape of a drum cartridge such that the developing device can be attached to the drum cartridge.

However, in order to use both of the integrated type developing cartridge and the separate type developing cartridge for one image forming apparatus, the drum cartridge needs to be configured to support both of the integrated type developing cartridge and the separate type developing cartridge, which may increase cost.

In consideration of the above, aspects of the present disclosure provide a drum cartridge configured such that a developing device and a developing cartridge can be selectively attached thereto.

According to an aspect of the disclosures, there is provided a drum cartridge, comprising: a photosensitive drum; and a drum frame having a first state where a developing device is attached to the drum frame, the developing device including a developing roller, and a second state where a developing cartridge is detachably attachable to the drum frame. The developing cartridge includes a developing roller and a developing frame which stores toner. In the first state, a toner cartridge is detachably attachable to the developing device.

BRIEF DESCRIPTION OF THE ACCOMPANYING DRAWINGS

DETAILED DESCRIPTION

Hereafter, an illustrative embodiment is described with reference to the accompanying drawings.

Figure 1:
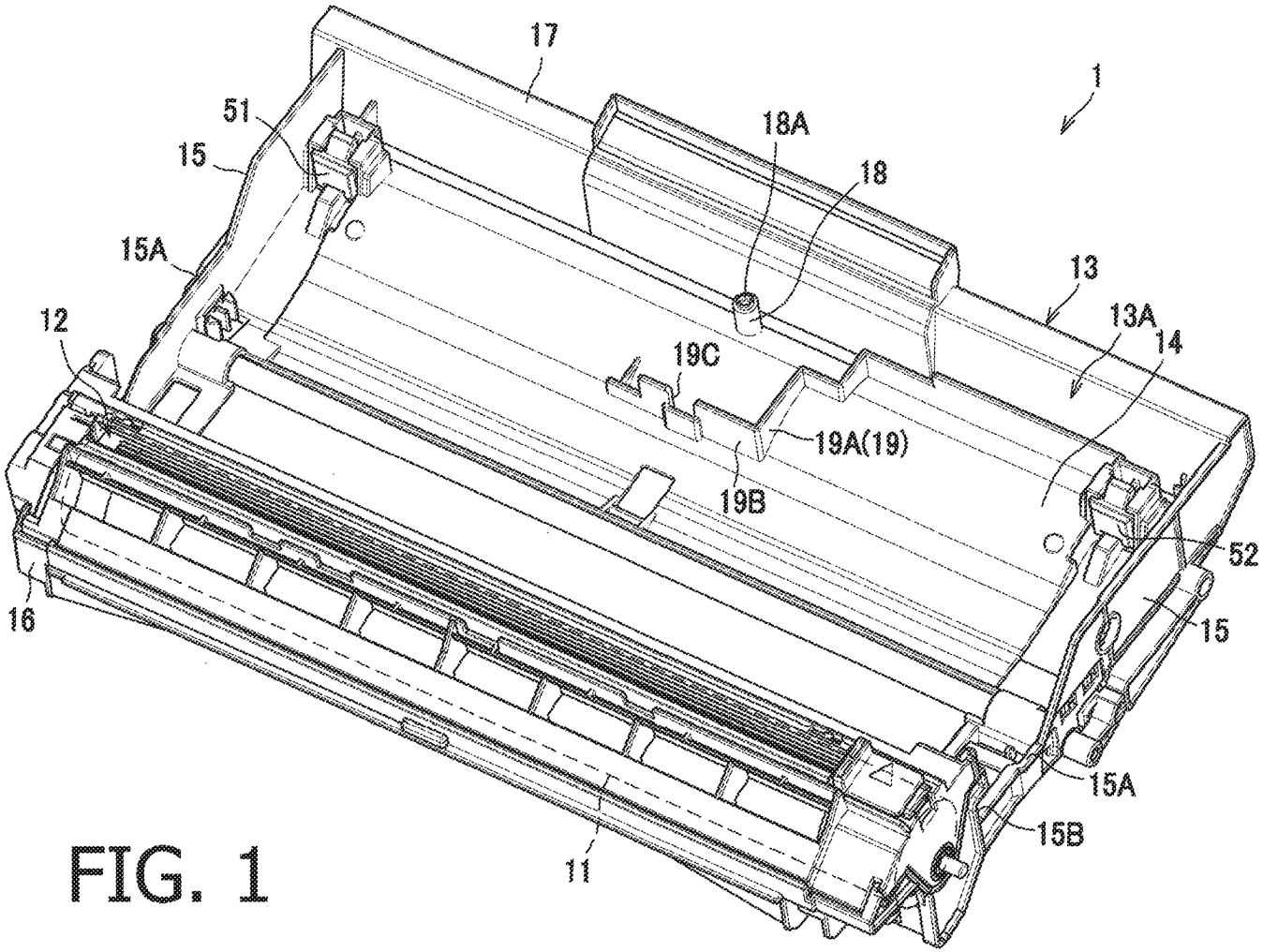
FIG. 1 is a perspective view of a drum cartridge according to an illustrative embodiment.

As shown in FIG. 1, a drum cartridge 1 includes a photosensitive drum 11, a charger 12 which charges the photosensitive drum 11, and a drum frame 13 which supports the photosensitive drum 11 and the charger 12. The drum fame 13 is made of resin.

Figure 2:
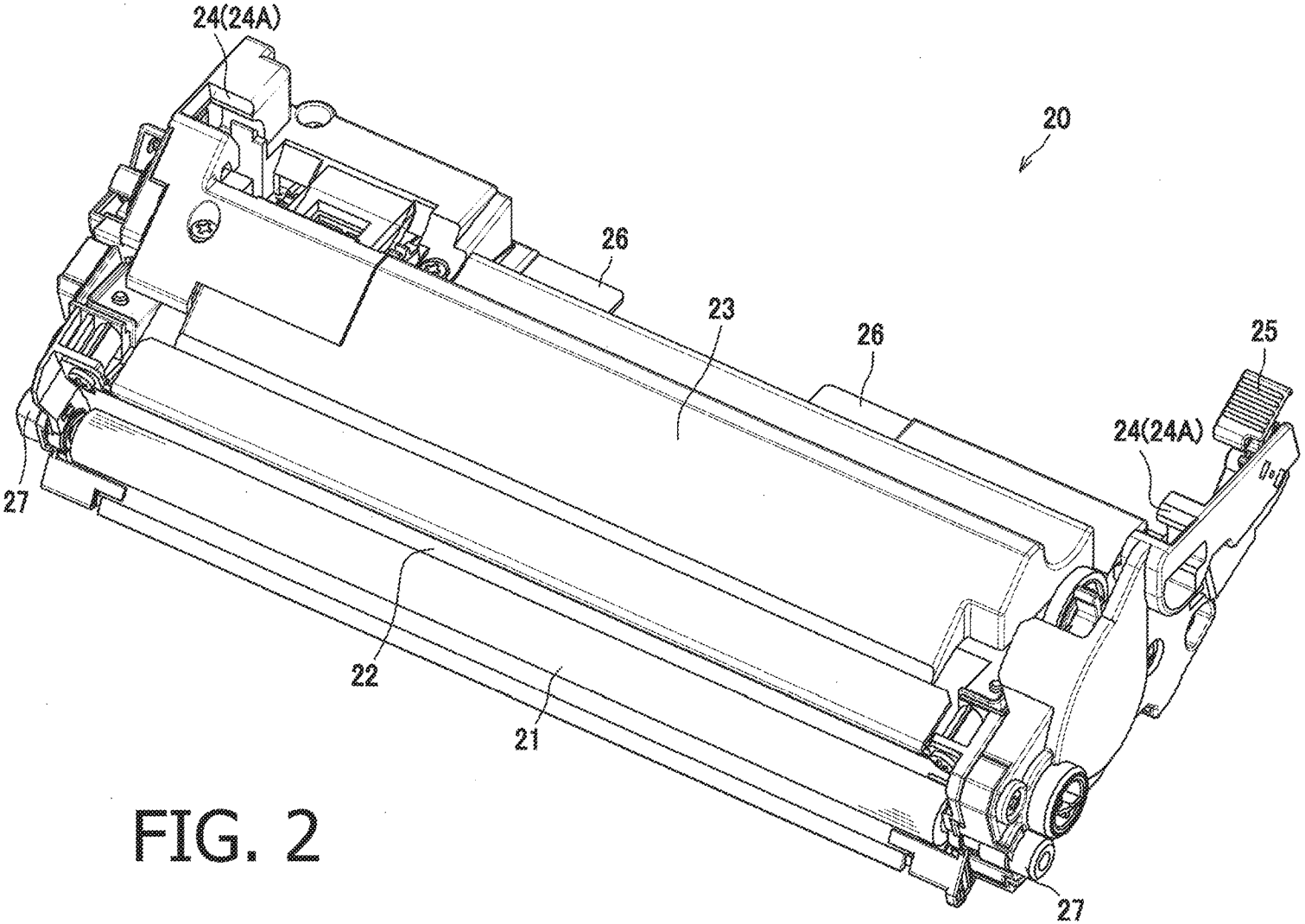
FIG. 2 is a perspective view of a developing device.
Figure 4:
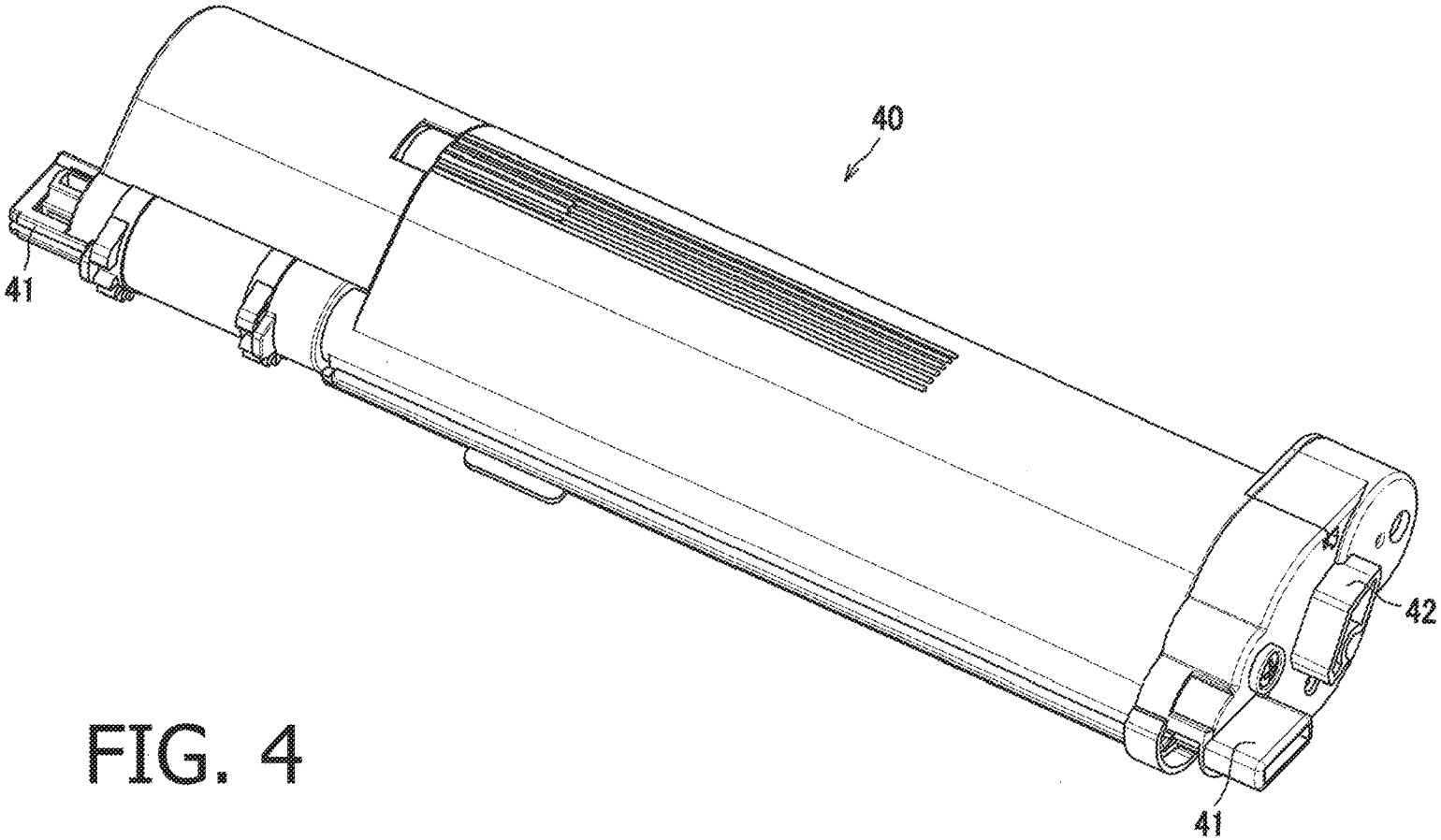
FIG. 4 is a perspective view illustrating a toner cartridge.
Figure 5:
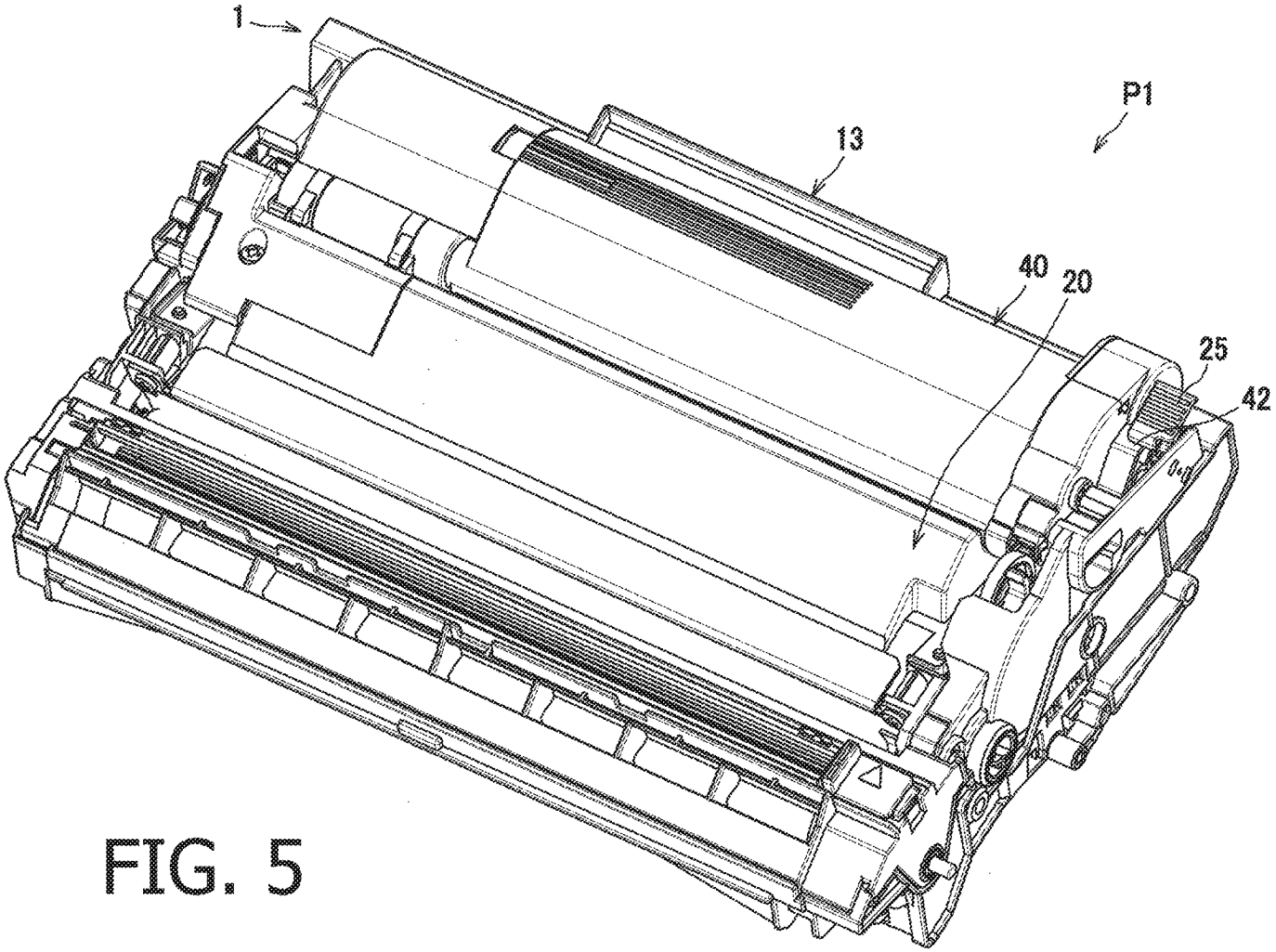
FIG. 5 is a perspective view of a first process cartridge configured by the drum cartridge, the developing device and the toner cartridge.
Figure 6:
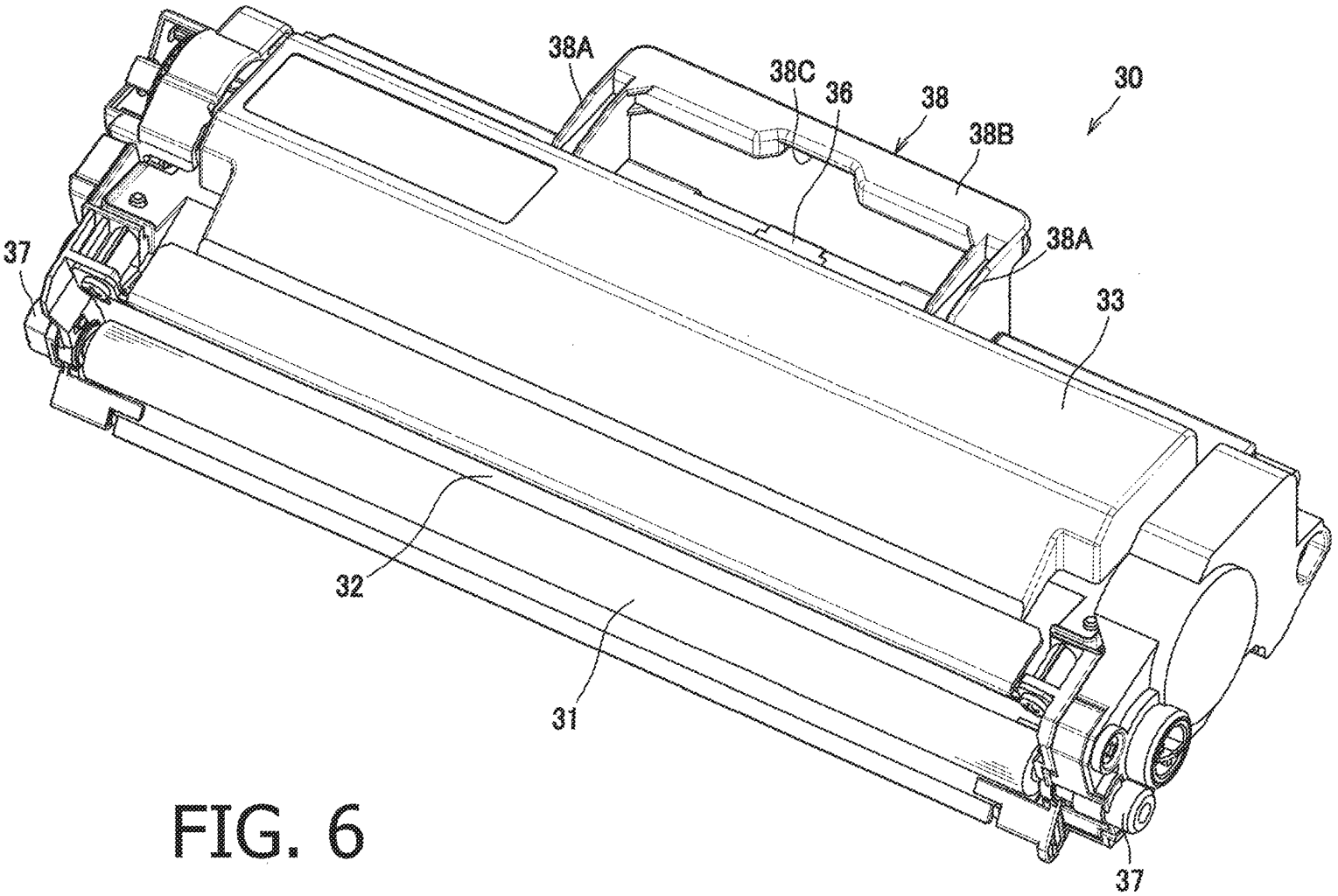
FIG. 6 is a perspective view of a developing cartridge.

The drum frame 13 has a first state (a state shown in FIG. 3) where a developing device 20 shown in FIG. 2 is attached to the drum frame 13 and a second state (a state shown in FIGS. 7 and 8) where a developing cartridge 30 shown in FIG. 6 is detachable attachable to the drum frame 13. In a state where the drum frame 13 is in the first state (the state shown in FIG. 3), a toner cartridge 40 shown in FIG. 4 is detachably attachable to the developing device 20 attached to the drum frame 13 (see FIG. 5). That is, both of a first process cartridge P1 shown in FIG. 5 and a second process cartridge P2 shown in FIG. 8 can be manufactured using the common drum cartridge 13.

As used herein, an expression "the first state where the developing device is attached" means a state where the developing device is attached to the drum frame (e.g., a state where the developing device is attached to the drum frame with screws). As used herein, an expression "the second state where the developing cartridge is detachably attachable" means a state where the developing cartridge is detachably attachable to the drum frame.

As shown in FIG. 2, the developing device 20 includes a developing roller 21, a layer thickness restricting blade 22, a supply roller (not shown), and a developing device frame 23. The developing device frame 23 is made of resin. The developing roller 21 and the layer thickness restriction blade 22 are positioned at one end portion of the developing device frame 23. The developing device frame 23 includes guide grooves 24 and a holding lever 25. The guide grooves 24 and the holding lever 25 are disposed at the other end portion of the developing device frame 23.

The guide groove 24 is configured to guide a protrusion 41. The protrusion 41 is disposed at each end surface of the toner cartridge 40 having a shape of a hollow cylinder. The guide groove 24 has an insertion opening 24A. The insertion opening 24A is configured to allow the protrusion 41 of the toner cartridge 40 to be inserted from the outside into the guide groove 24. The guide grove 24 supports the protrusion 41 such that the protrusion 41 is rotatable between a first position where the protrusion 41 can be withdrawn from the guide groove 24 to the outside through the insertion opening 24A and a second position where the protrusion 41 is rotated approximately 90 degrees from the first position. At the second position, the protrusion 41 cannot be withdrawn from the guide groove 24 through the insertion opening 24A.

The holding lever 25 is configured to be rotatable between a third position and a fourth position. In a case where the holding lever 25 is at the third position, the holding lever 25 engages with an engagement protrusion 42 disposed at one end surface of the toner cartridge 40. In a case where the holding lever 25 is at the fourth position, the holding lever 25 is disengaged from the engagement protrusion 42 of the toner cartridge 40. The holding lever 25 is pressed to the third position by a spring (not shown). The holding lever 25 is configured such that, in a case where the protrusion 41 is at the second position, the holding lever 25 engages with the engagement protrusion 42 of the toner cartridge 40 and holds the toner cartridge 40.

The guide grooves 24 and the holding lever 25 are disposed at the other end portion of the developing device frame 23. The toner cartridge 40 is detachably attachable to the developing device frame 23. The toner cartridge 40 includes a toner storing chamber which stores toner and an agitator which agitates toner in the toner storing chamber.

The developing device frame 23 includes two plate-like first engagement parts 26. The first engagement parts 26 are disposed at the other end portion of the developing device frame 23. The first engagement parts 26 are separated from each other in a rotation axis direction of a developing roller 21. Each first engagement plate 26 extends from the developing device frame 23 in a direction of departing from the developing roller 21.

The developing device frame 23 includes two guided parts 27. The guided parts 27 extend outward in the rotation axis direction, respectively. The guided part 27 has a cylindrical shape of which center axis is the rotation axis of the developing roller 21.

As shown in FIG. 6, the developing cartridge 30 includes a developing roller 30, a layer thickness restricting blade 32, a supply roller (not shown), a developing frame 33, and an agitator (not shown). The developing frame 33 has a toner storing chamber which stores toner. That is, the developing cartridge 30 is configured as an integrated type developing cartridge in which a developing device and a toner cartridge are integrally provided.

The developing frame 33 is made of resin. The developing frame 33 includes the layer thickness restricting blade 32 at one end portion of the developing frame 33, and a second engagement part 36 at the other end portion of the developing frame 33. The second engagement part 36 is disposed at a central portion if the developing frame 33 in the rotation axis direction of the developing roller 31. The second engagement part 36 extends from the developing frame 33 in a direction of departing from the developing roller 31.

Other end portion of the developing frame 33 includes a handle 38 extending from the developing frame 33 in a direction of departing from the developing roller 31. The handle 38 includes two first parts 38A and one second part 38B. The first parts 38A extends from the developing frame 33. The first parts 38A are separated from each other in the rotation axis direction. The second part 38B connects both ends of the first parts 38A at the opposite side of the developing roller 31. The second part 38B includes a recession 38C recessed to the direction of departing from the developing roller 31.

One end portion of the developing frame 33 includes two guided parts 37 extending outward in the rotation axis direction. The guided part 37 has a cylindrical shape of which center axis is equal to the rotation axis of the developing roller 31.

As shown in FIG. 1 the drum frame 13 includes a housing recession 13A which stores the developing device 20 or the developing cartridge 30. Specifically, the drum frame 13 includes a rectangular bottom wall 14, two side walls 15, and a first connection wall 16 and a second connection wall 17. The bottom wall 14 is a bottom of the housing recession 13A. The two side walls 15 extend in a direction from the both ends of the bottom wall 14 in the rotation axis direction of the photosensitive drum 11. The first connection wall 16 and the second connection wall 17 connect the side walls 15 and the bottom wall 14.

The photosensitive drum 11 is disposed between each side wall 15 in the axis direction of the photosensitive drum 11. Each side wall 15 includes a guide surface 15A configured to guide the guided part 27 of the developing device 20 or the guided part 37 of the developing cartridge 30. Further, each side wall 15 includes a holding groove 15B configured to restrict movement of the guided part 27 or 37 in a direction perpendicularly intersecting with the bottom wall 14. The holding groove 15B is disposed at an end portion of the side wall 15.

The photosensitive drum 11 is disposed at one end portion of the drum frame 13. The photosensitive drum 11 is disposed at the end portion of the side wall 15. The drum cartridge 1 includes a first pressing member 51, a second pressing member 52. The first pressing member 51 and the second pressing member 52 are disposed at an end portion of the bottom wall 14.

The first pressing member 51 is configured to press the developing device 20 or the developing cartridge 30 toward the photosensitive drum 11. The first pressing member 51 is pressed toward the photosensitive drum 11 by a spring (not shown).

The second pressing member 52 is configured to press the developing device 20 or the developing cartridge 30 toward the photosensitive drum 11. The second pressing member 52 is pressed toward the photosensitive drum 11 by a spring (not shown). The second pressing member 52 is disposed to be spaced from the first pressing member 51 in the rotation axis direction of the photosensitive drum 11. Specifically, the first pressing member 51 is disposed at one end portion of the bottom wall 14 in the rotation axis direction, and the second pressing member 52 is disposed at the other end portion of the bottom wall 14 in the rotation axis direction.

The drum frame 13 includes a boss 18 and a rib 19. The boss 18 and the rib 19 are disposed at the bottom wall 14. The boss 18 extends from the bottom wall 14 toward an opening of the housing recession 13A. The boss 18 is disposed between the first pressing member 51 and the second pressing member 52 in the rotation axis direction. Specifically, the boss 18 is disposed at the central portion of the bottom wall 14 in the rotation axis direction. More specifically, the first pressing member 51, the boss 18 and the second pressing member 52 are aligned in a straight line along the rotation axis direction.

The boss 18 has a cylindrical shape, and has a first hole 18A therein. Into the first hole 18A, a screw S can be screwed so as to attach an attachment member 60 shown in FIG. 3 or a locking member 70 shown in FIG. 7 to the drum frame 13. That is, to the boss 18, the attachment member 60 and the locking member 70 can be selectively attached.

The screw S is a common screw used for attaching both of the attachment member 60 and the locking member 70. In the first state shown in FIG. 3, the attachment member 60 includes the screw S. In the second state shown in FIG. 7, the locking member 70 includes the screw S.

The rib 19 is used to position a portion of the locking member 70 (specifically, a body unit 71 described later) with respect to the drum frame 13. The rib 19 extends from the bottom wall 14 toward the opening of the housing recession 13A. The rib 19 includes a first rib 19A and a second rib 19B. The first rib 19A is disposed at one side with respect to the boss 18 in the rotation axis direction. The second rib 19B extends toward the other side with respect to the boss 18 in the rotation axis direction from one end of the first rib 19A. The rib 19A and the rib 19B are formed to be similar to an outer periphery of the body unit 71 of the locking member 70 described later. The second rib 19B has a notch 19C into which a portion of the locking member 70 (an engagement part 71B described later; see FIG. 11) is fitted.

Figure 3:
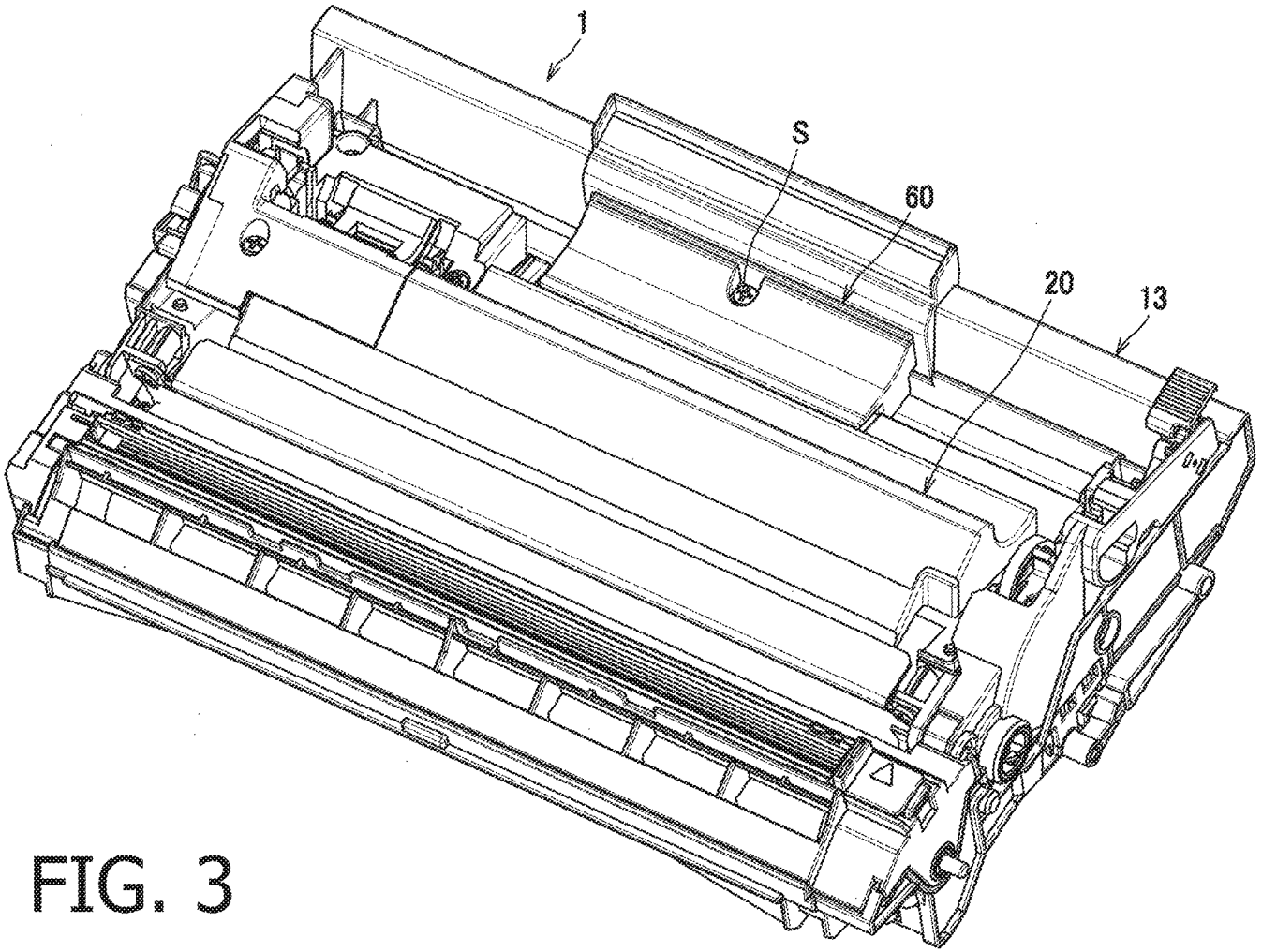
FIG. 3 is a perspective view illustrating the drum cartridge in a first state.

As shown in FIG. 3, in the first state, the attachment member 60 is configured to attach the developing device 20 to the drum frame 13. That is, in the first state, the drum cartridge 1 includes the attachment member 60. The length of the attachment member 60 in the rotation axis direction is longer than the length (the maximum length) of the locking member 70 in the rotation axis direction.

The attachment member 60 is made of resin. The attachment member 60 is disposed between the first pressing member 51 and the second pressing member 52 (see FIG. 1). In other words, the first pressing member 51, the attachment member 60 and the second pressing member 52 are aligned in a straight line long the rotation axis direction.

Figure 9:
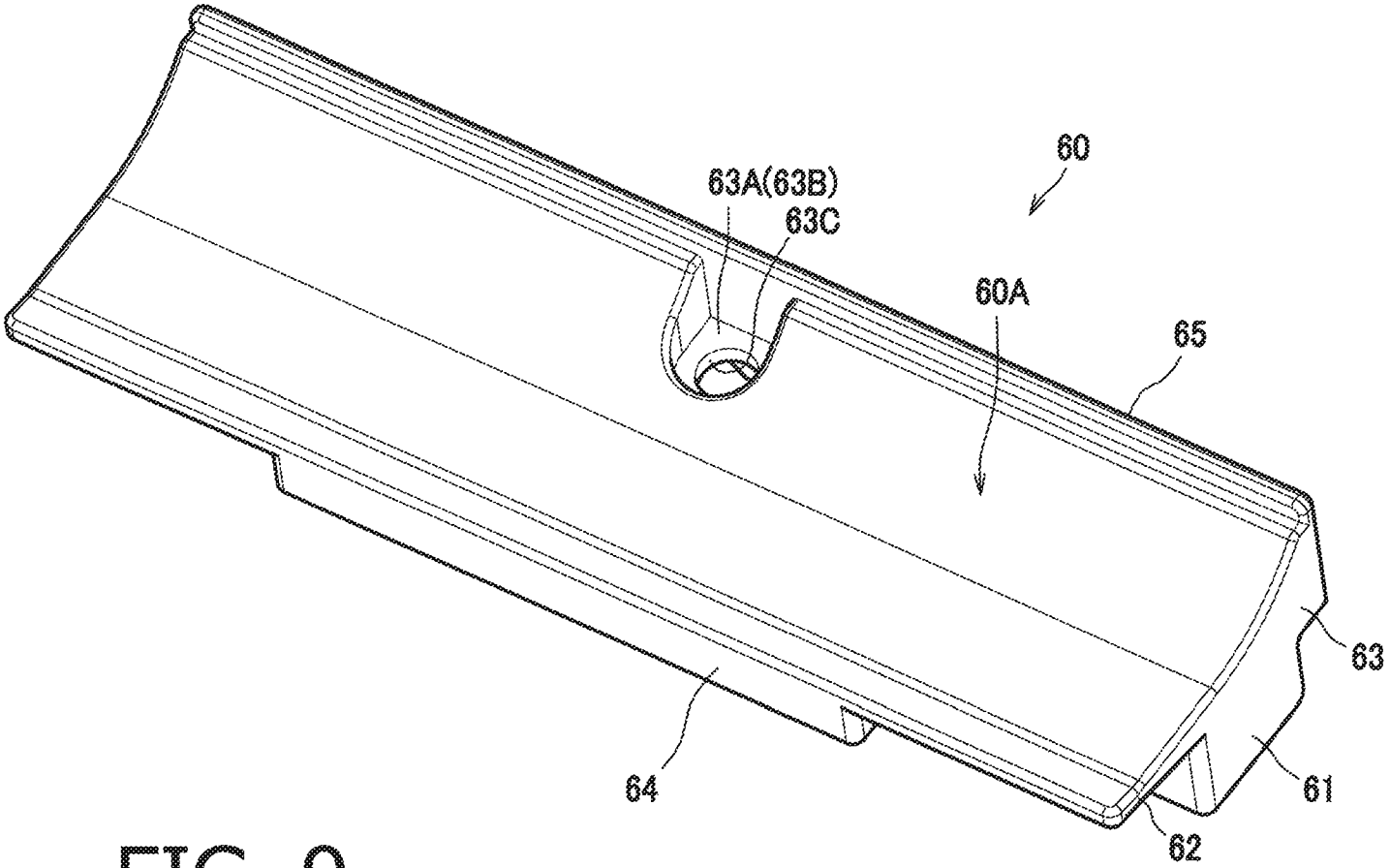
FIG. 9 is a perspective view of an attachment member according to the illustrative embodiment.

As shown in FIG. 9, the attachment member 60 includes a body unit 61, a plate 62, and an extending part 63. The body unit 61 is configured to contact the bottom wall 14 of the drum frame 13. The plate 62 extends from the body unit 61 in a pressing direction of the first pressing member 51. The extending part 63 extends from the body unit 61 in an opposite direction of the pressing direction.

Figure 10:
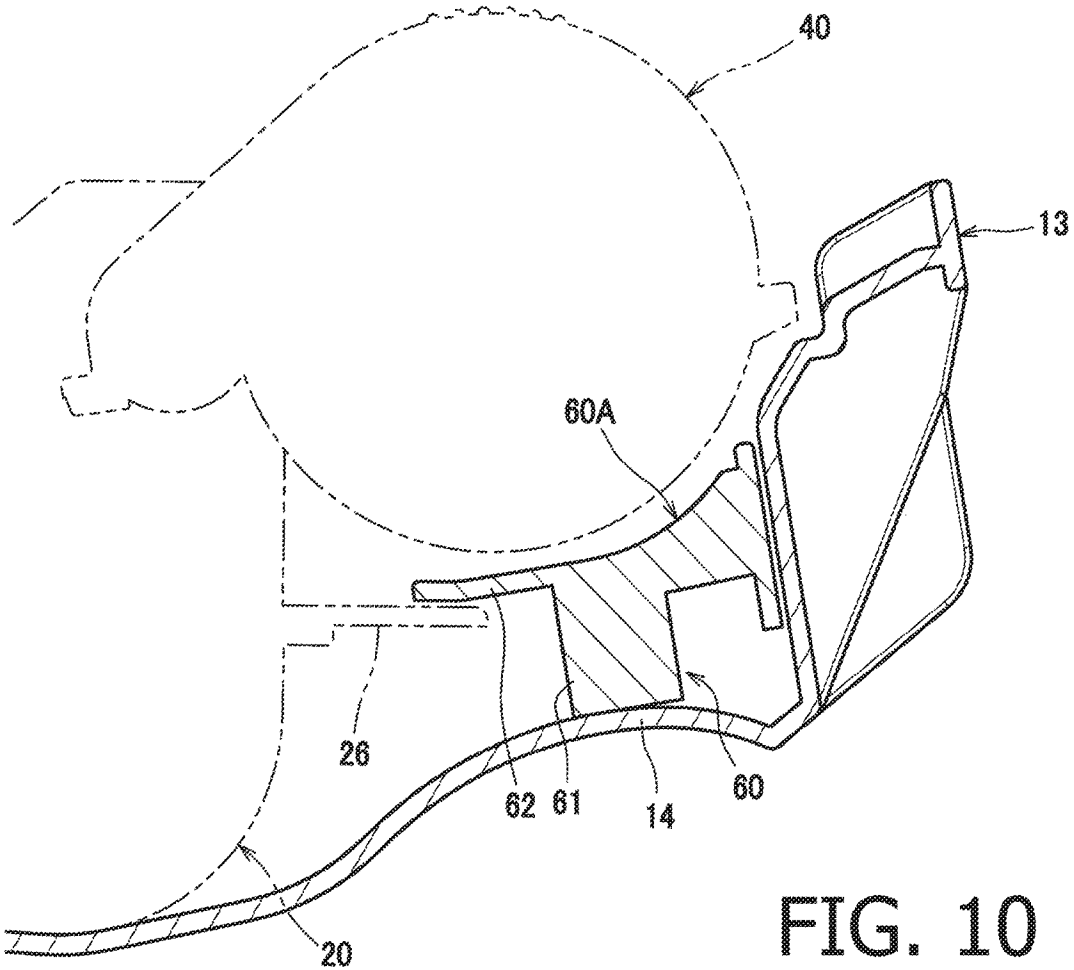
FIG. 10 is a cross sectional view illustrating a relationship between a plate of the attachment member and an engagement part of the developing device.

The body unit 61 has a long rectangular parallelepiped elongated in the rotation axis direction. In a state where a surface of the body unit 61 facing the bottom wall 14, the rib 19 is inserted into the recession (not shown). As shown in FIG. 10, the body unit 61 is disposed to be spaced from the developing device 20 in the pressing direction.

Returning to FIG. 9, the plate 62 extends in the pressing direction from an end of the body unit 61 at an opposite side of the drum frame 13 (specifically, the bottom wall 14). In a central portion of the plate 62 in the rotation axis direction, a protrusion 64 extends from the plate 62 toward the bottom wall 14 of the drum frame 13.

The length of the protrusion 64 in the rotation axis direction is smaller than the interval between the first engagement parts 26 of the developing device 20 shown in FIG. 2. In a state where the developing device 20 is attached to the drum frame 13 with the attachment member 60, the protrusion 64 fits into the interval between the first engagement parts 26. As a result, movement of the developing device 20 in the rotation axis direction is locked by the protrusion 64.

As shown in FIG. 10, in a state where the developing device 20 is attached to the drum frame 13 with the attachment member 60, the plate 62 is disposed at an opposite side of the bottom wall 14 of the drum frame 13 with respect to the first engagement part 26 being a portion of the developing device 20. Specifically, the plate 62 is disposed at the opposite side of the bottom wall 14 of the drum frame 13 with respect to the first engagement part 26 in a first direction perpendicularly intersecting with the pressing direction and the rotation axis direction. In other words, the plate 62, the first engagement part 26 and the bottom wall 14 are aligned in a straight line along the first direction.

In the first direction, the interval between the plate 62 and the bottom wall 14 of the drum frame 13 is larger than the length (thickness) of the first engagement part 26. Specifically, the first engagement part 26 is disposed to have a first interval with respect to the plate 62. The first engagement part 26 is disposed to have a second interval with respect to the bottom wall 14 of the drum frame 13. The second interval is larger than the first interval.

Returning to FIG. 2, the extending part 63 extends in an opposite direction of the pressing direction from an end of the body unit 61 at the opposite side of the drum frame 13 (specifically, the bottom wall 14). Surfaces of the plate 62, the body unit 61 and the extending part 63 at the opposite side of the bottom wall 14 of the drum frame 13 are connected to each other. The attachment member 60 has an inclined surface 60A. Specifically, the inclined surface 60A is a curved surface inclined to the bottom wall 14 of the drum cartridge 13 toward the pressing direction. The inclined surface 60A is formed to be along an outer circumferential surface of the toner cartridge 40 (see FIG. 10).

The extending part 63 has a recession 63A. The recession 63A is at a central portion of the extending part 63 in the rotation axis direction. The recession 63A is recessed toward the bottom wall 14 of the drum frame 13. A bottom wall 63B of the recession 63A has a second hole 63C. The screw S (see FIG. 3) is inserted into the second hole 63C. At an end of the extending part 63 at the opposite side of the body unit 61, a protrusion 65 extends from the extending part 63 to depart from the bottom wall 14.

Figure 7:
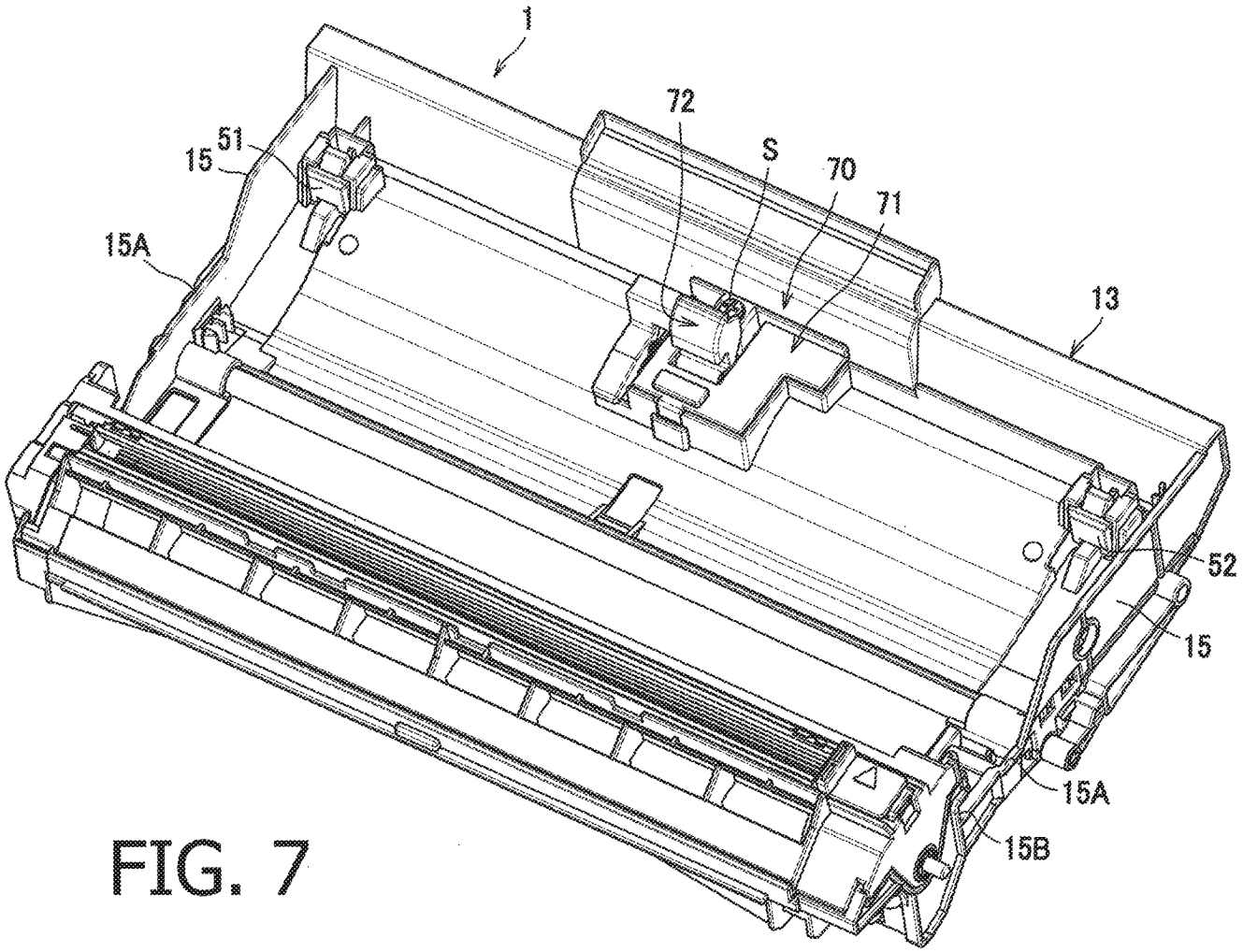
FIG. 7 is a perspective view illustrating a situation where the developing cartridge is detached from the drum cartridge in a second state.
Figure 8:
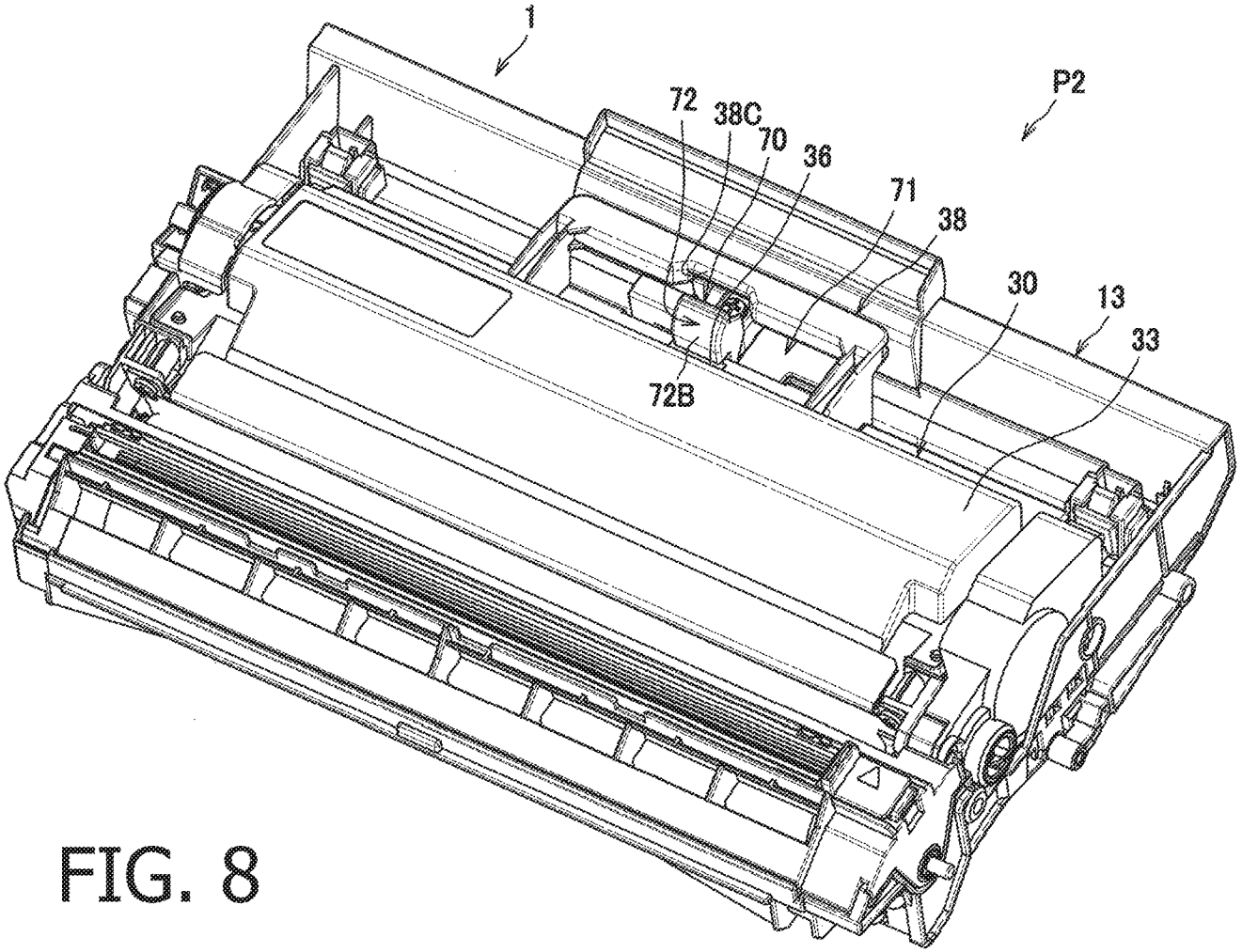
FIG. 8 is a perspective view illustrating a situation where the developing cartridge is attached to the drum cartridge in the second state.

As shown in FIGS. 7 and 8, the locking member 70 is configured to lock the developing cartridge 70 to the drum frame 13 in a state where the developing cartridge 30 is attached to the drum frame 30 in the second state. That is, in the second state, the drum cartridge 1 has the locking member 70.

The locking member 70 is disposed between the first pressing member 51 and the second pressing member 52. In other words, the first pressing member 51, the locking member 70 and the second pressing member 52 are aligned in a straight line along the rotation axis direction.

Figure 11:
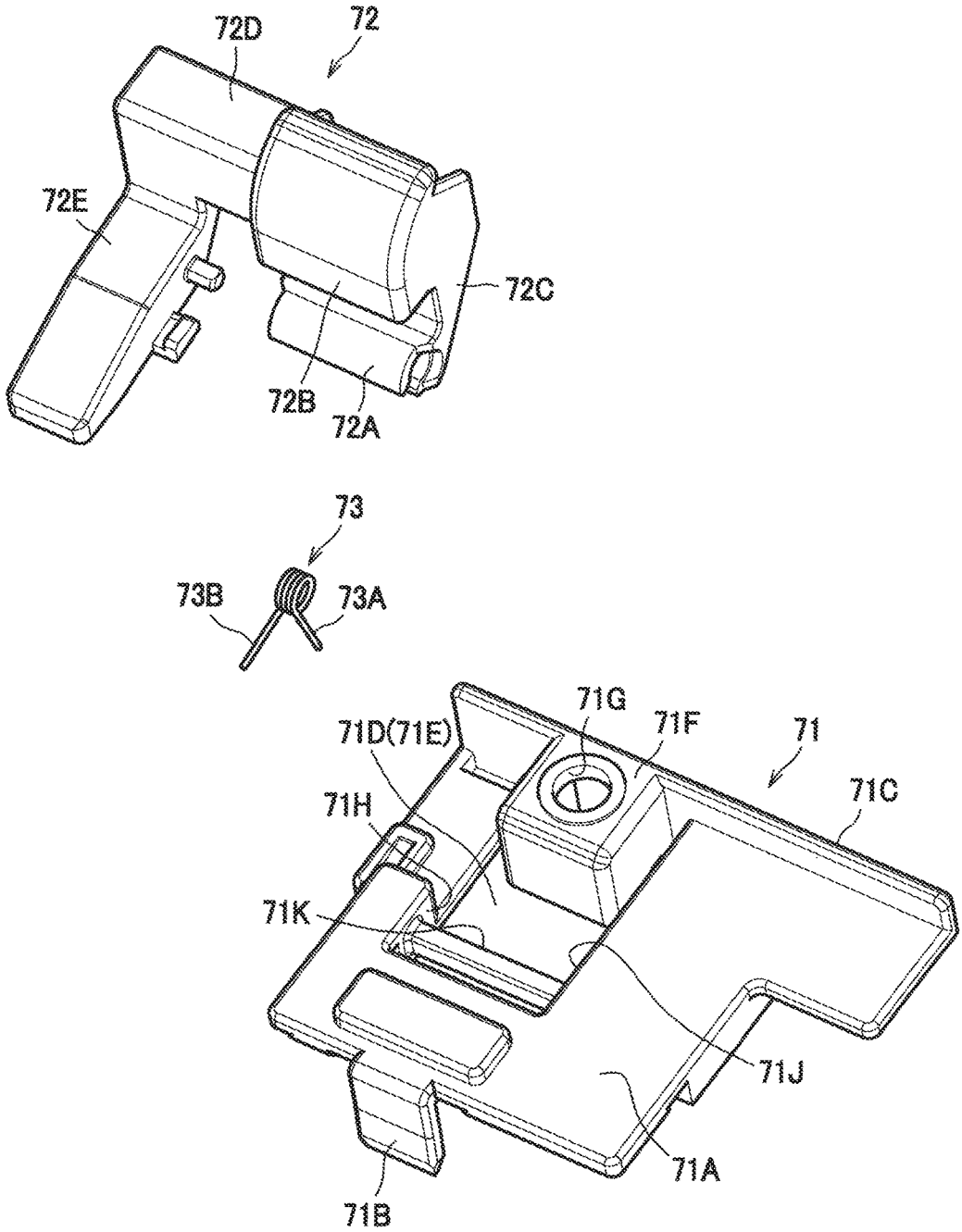
FIG. 11 is an exploded perspective view of a locking member according to the illustrative embodiment.

As shown in FIG. 11, the locking member 70 includes the body unit 71, a lever 72, and a metal torsion spring 73. The body unit 71 is made of resin. The lever 72 is made of resin. The metal torsion spring 73 is disposed between the body unit 71 and the lever 72.

The body unit 71 includes a plate-like base part 71A, an engagement part 71B, and a protrusion 71C. The base part 71A has a recession 71D. The recession 71D is recessed toward the bottom wall 14. The engagement part 71B extends toward the bottom wall 14 of the drum frame 13 from an end of the base part 71A. The protrusion 71C extends to an opposite direction of the extending direction of the engagement part 71B from the opposite end of the base part 71A.

A bottom wall 71E of the recession 71D includes an expanding part 71F. The expanding part 71F expands to a direction of departing from the bottom wall 14 at an end of the bottom wall 14E on the protrusion 71C side. A tip part of the expanding part 71F has a third hole 71G into which the screw S (see FIG. 7) is inserted. With this configuration, the body unit 41 is attached to the drum frame 13 with the screw S (see FIG. 7).

The recession 71D has two side wall parts 71H and 71J facing with each other in the rotation axis direction. The body unit 71 includes a shaft part 71K. The shaft part 71K is disposed between the side wall parts 71H and 71J. The shaft part 71K rotatably supports the lever 72. The shaft part 71K is connected to the side wall parts 71H and 71J.

The lever 72 includes a bearing part 72A, a hook part 72B, a connection part 72C, an extending part 72D, and a push-up part 72E. The bearing part 72A rotatably engages with the shaft part 71K. The hook part 72B engages with the second engagement part 36 (see FIG. 6). The connection part 72C connects the shaft part 72A and the hook part 72B. The extending part 72D extends from the connection part 72C toward the first pressing member 51 (see FIG. 7). The push-up part 72E extends from the extending part 72D toward the bottom wall 14 and subsequently extending toward the photosensitive drum 11. In a state where the developing cartridge 30 is attached to the drum frame 13, the lever 72 is rotatable between a first position where the hook part 72B contacts the second engagement part 36 of the developing cartridge 30 and a second position the hook part 72B is separated from the second engagement part 36 of the developing cartridge 30.

Instead of rotation of the lever 72, the locking member 70 may be configured such that the lever 72 is movable between the first position and the second position. In other words, in the state where the developing cartridge 30 is attached to the drum frame 13, the locking member 70 may be movable between the first position where the locking member 70 locks developing cartridge 30 with respect to the drum frame 13 and the second position where the locking member 70 separates from the developing cartridge 30 and allows the developing cartridge 30 to be detached from the drum frame 13.

At the first position of the lever 72, the lever 72 locks the developing cartridge 30 with respect to the drum frame 13. Further, at the second position of the lever 72, the lever 72 allows the developing cartridge 30 to be detached from the drum frame 13. Furthermore, by rotate the lever 72 from the first position to the second position, the tip part of the push-up part 72E moves to depart from the bottom wall 14 of the drum frame 13, and pushes up the developing cartridge 30 to depart from the bottom wall 14.

As shown in FIG. 8, in a state where the developing cartridge 30 is attached to the drum frame 13, the lever 72 is disposed between the developing frame 33 and the handle 38. Furthermore, in a state where the developing cartridge 30 is attached to the drum frame 13, in a state where the lever 72 is at the second position, a portion of the hook part 72B of the lever 72 enters the recession 38C of the handle 38.

An end of the torsion spring 73 engages with the body unit 71, and the other end of the torsion spring 73 engages with the lever 72. The torsion spring 73 presses the lever 27 toward the first position.

Hereafter, an assembling method (a manufacturing method) of the first process cartridge P1 and the second process cartridge P2 is explained. First, an assembling method of the first process cartridge P1 is explained.

First, the developing device 20 is moved while letting the guided parts 27 of the developing device 20 shown in FIG. 2 slide on the guide surfaces 15A of the drum frame 13 shown in FIG. 1 so that the guided parts 27 are disposed at the holding grooves 15B. Then, as shown in FIGS. 1 to 3, the attachment member 60 is attached to the boss 18 of the drum frame 13 with the screw S so that the first engagement parts 26 of the developing device 20 are sandwiched between the attachment member 60 and the bottom wall 14 of the drum frame 13.

Thus, the developing device 20 is attached to the drum frame 13 by the attachment member 60. Thereafter, by attaching the toner cartridge 49 shown in FIG. 4 to the developing device 20 attached to the drum frame 13, an assembling work for the first process cartridge P1 is completed as shown in FIG. 5.

Next, an assembling method for the second process cartridge P2 is explained.

First, as shown in FIGS. 1 and 7, the body unit 71 of the locking member 70 is attached to the boss 18 of the drum frame 13 with the screw S. Then, the developing cartridge 30 is moved while letting the guided parts 37 of the developing cartridge 30 shown in FIG. 6 slide on the guide surfaces 15A of the drum frame 13 shown in FIG. 7 so that the guided parts 37 are disposed in the holding grooves 15B. Thereafter, the second engagement part 36 of the developing cartridge 30 is pushed toward the lever 72 of the locking member 70. As a result, after the lever 72 moves from the first position to the second position against the pressing force of the spring 73, the lever 72 returns again to the first position by the pressing force of the spring 73 and engages with the second engagement part 36 as shown in FIG. 8. Thus, an assembling work for the second process cartridge P2 is completed.

According to the above described illustrative embodiment, the following advantage effects are attached.

The drum frame 13 has the first state where the developing device 20 is attached to the drum frame 13 and the second state where the developing cartridge 30 is detachably attachable to the drum frame 13. Therefore, the developing device 20 and the developing cartridge 30 can be selectively attached to the same drum cartridge 1. Consequently, cost can be reduced in comparison with a case where different drum cartridges are respectively prepared for the developing device 20 and the developing cartridge 30.

Since the interval between the plate 62 of the attachment member 60 and the bottom wall 14 of the drum frame 13 is larger than the thickness of the first engagement part 26 of the developing device 20, it is possible to make the developing device 20 to be easily moved in the pressing direction.

It is understood that the present disclosure is not limited to the above described illustrative embodiment, and the illustrative embodiment can be varied in various ways.

In the above described illustrative embodiment, the lever 72 which engages with the developing cartridge 30 is configured to be rotatable; however, an engagement part to be engaged with a developing cartridge may be configured to be movable straightly between a first position and a second position.

What is claimed is:

1. A drum cartridge, comprising:

a photosensitive drum; and a drum frame configurable in first and second states, wherein in the first state a developing device is attached to the drum frame, the developing device including a first developing roller, and a toner cartridge is detachably attachable to the developing device; and in the second state a developing cartridge is detachably attachable to the drum frame, the developing cartridge including a second developing roller and a developing frame which stores toner.

2. The drum cartridge according to claim 1, further comprising an attachment member configured to attach the developing device to the drum frame in the first state.

3. The drum cartridge according to claim 2,
further comprising:
a first pressing member configured to press the developing device toward the photosensitive drum; and
a second pressing member configured to press the developing device toward the photosensitive drum, the second pressing member being disposed to be spaced with respect to the first pressing member in a rotation axis direction of the photosensitive drum,
wherein the attachment member is disposed between the first pressing member and the second pressing member.

4. The drum cartridge according to claim 3,
wherein the attachment member comprises:
a body unit configured to contact the drum frame; and
a plate extending from the body unit in a pressing direction of the first pressing member, the plate being disposed at an opposite side of the drum frame with respect to a portion of the developing device in a particular direction perpendicularly intersecting with the pressing direction and the rotation axis direction of the photosensitive drum,
wherein:
the body unit is disposed to be spaced from the developing device in the pressing direction; and
in the particular direction, an interval between the plate and the drum frame is larger than a length of the portion of the developing device.

5. The drum cartridge according to claim 2,
further comprising a boss extending from the drum frame, the boss having a first hole,
wherein:
the attachment member has a second hole;
the attachment member includes a screw configured to be inserted into the first hole and the second hole.

6. The drum cartridge according to claim 1,
further comprising a locking member configured to lock the developing cartridge with respect to the drum frame in a state where the developing cartridge is attached to the drum frame in the second state.

7. The drum cartridge according to claim 6,
further comprising:
a first pressing member configured to press the developing cartridge toward the photosensitive drum; and
a second pressing member configured to press the developing cartridge toward the photosensitive drum, the second pressing member being disposed to be spaced with respect to the first pressing member in an rotation axis direction of the photosensitive drum,
wherein the locking member is disposed between the first pressing member and the second pressing member.

8. The drum cartridge according to claim 7,
wherein, in a state where the developing cartridge is attached to the drum frame, the locking member is movable between a first position where the locking member locks developing cartridge with respect to the drum frame and a second position where the locking member separates from the developing cartridge and allows the developing cartridge to be detached from the drum frame.

9. The drum cartridge according to claim 7,
wherein, in a state where the developing cartridge is attached to the drum frame, the locking member is rotatable between a first position where the locking member locks developing cartridge with respect to the drum frame and a second position where the locking member separates from the developing cartridge and allows the developing cartridge to be detached from the drum frame.

10. The drum cartridge according to claim 8,
wherein the locking member comprises:
a body unit configured to contact the drum frame; and
a lever supported by the body unit,
wherein the lever is rotatable between the first position and the second position.

11. The drum cartridge according to claim 6,
further comprising a boss extends from the drum frame, the boss having a first hole,
wherein:
the locking member has a second hole;
the locking member includes a screw being inserted into the first hole and the second hole.

12. The drum cartridge according to claim 1,
wherein:
in the first state, the drum cartridge comprises an attachment member configured to attach the developing device to the drum frame;
in the second state, the drum cartridge comprises a locking member configured to lock the developing cartridge with respect to the drum frame in a state where the developing cartridge is attached to the drum frame; and
a length of the attachment member in a rotation axis direction of the photosensitive drum is longer than a length of the locking member in the rotation axis direction of the photosensitive drum.

* * * * *